US010156233B2

(12) United States Patent
Ren et al.

(10) Patent No.: US 10,156,233 B2
(45) Date of Patent: Dec. 18, 2018

(54) DUAL CONTROL VALVE FOR RECIPROCATING COMPRESSOR UNLOADER SYSTEM

(71) Applicant: QUINCY COMPRESSOR LLC, Bay Minette, AL (US)

(72) Inventors: Tingrong Ren, Quincy, IL (US); Keith Stephens, Quincy, IL (US); Gary Hyer, Quincy, IL (US)

(73) Assignee: QUINCY COMPRESSOR LLC, Bay Minette, AL (US)

( * ) Notice: Subject to any disclaimer, the term of this patent is extended or adjusted under 35 U.S.C. 154(b) by 0 days.

(21) Appl. No.: 15/799,535

(22) Filed: Oct. 31, 2017

(65) Prior Publication Data

US 2018/0119690 A1 May 3, 2018

Related U.S. Application Data

(62) Division of application No. 14/146,593, filed on Jan. 2, 2014, now Pat. No. 9,835,147.

(60) Provisional application No. 61/748,213, filed on Jan. 2, 2013.

(51) Int. Cl.

| | |
|---|---|
| ***F04B 49/03*** | (2006.01) |
| ***F04B 49/22*** | (2006.01) |
| ***F04B 39/10*** | (2006.01) |
| *F04B 53/06* | (2006.01) |

(52) U.S. Cl.

CPC ..... *F04B 49/03* (2013.01); *F04B 39/10* (2013.01); *F04B 49/22* (2013.01); *F04B 49/225* (2013.01); *F04B 53/06* (2013.01); *Y10T 137/7758* (2015.04)

(58) Field of Classification Search

CPC ..... F04B 39/10; F04B 49/22; F04B 49/225; F04B 41/02; F04B 49/03; F04B 49/243; F04B 53/06; F04B 27/24; F04B 49/00; Y10T 137/7758; Y10T 137/777; Y10T 137/7905; Y10T 137/7922; Y10T 137/85986; Y10S 137/903; F25B 1/02; F25B 2600/0262; F25B 49/022

See application file for complete search history.

(56) References Cited

U.S. PATENT DOCUMENTS

| | | | | |
|---|---|---|---|---|
| 2003/0021703 | A1* | 1/2003 | Wallis | F04B 49/225 417/298 |
| 2004/0213679 | A1* | 10/2004 | Cornwell | F04B 39/10 417/307 |
| 2007/0056636 | A1* | 3/2007 | Cornwell | F16K 15/142 137/535 |
| 2013/0139535 | A1* | 6/2013 | Nares | F04B 49/00 62/228.1 |

* cited by examiner

*Primary Examiner* — Dominick L Plakkoottam
(74) *Attorney, Agent, or Firm* — Bacon & Thomas, PLLC

(57) ABSTRACT

A continuous run controller for a dual control compressor system includes an integrated housing containing a pilot valve and a hydraulic unloader valve. Low pressure in the hydraulic oil system opens the hydraulic unloader valve such that the suction valve unloader assembly unloads the compressor. High pressure in an air receiver of the compressor system opens the pilot valve such that the suction valve unloader assembly unloads the compressor.

8 Claims, 5 Drawing Sheets

DUAL CONTROL VALVE FOR RECIPROCATING COMPRESSOR UNLOADER SYSTEM

REFERENCE TO CO-PENDING APPLICATIONS

This application claims the benefit of the filing date of U.S. Provisional Patent Application No. 61/748,213, filed on 2 Jan. 2013, and entitled DUAL CONTROL VALVE FOR RECIPROCATING COMPRESSOR UNLOADER SYSTEM, the disclosure of which is incorporated, in its entirety, by reference.

The technology of the present application relates generally to gas compressors and, more specifically, to dual control gas compressors.

BACKGROUND OF THE INVENTION

Pressurized gases, such as, air, helium, nitrogen, halogen, and the like, have many uses in industry. In general, pressurized gas systems work by providing a receiver, also commonly known as a tank, canister, reservoir, etc., which receives and stores the compressed gas for use at a later time. A discharge on the receiver is accessed to disburse some of the compressed gas from the receiver, which correspondingly reduces the pressure of the gas contained in the receiver.

A gas compressor is a mechanical device used to recharge or pressurize the receiver after a determined volume of pressurized gas has been discharged from the receiver or the receiver pressure has decreased to a predetermined value. The gas compressor is a mechanical device that increases the pressure of gas by reducing its volume. Generically, the term gas compressor and air compressor may be used interchangeably herein. Many gas compressors draw gas from the atmosphere, in other words, air. In any event, a volume of air is inducted into the compressor and then mechanically compressed into a smaller volume in the compression chamber. The compressed air is discharged from the compressor and stored in an air receiver. Compressed air is used for a wide range of applications. As the air is used from the receiver, the compressor needs to compress more air to keep up with the demand. A common method of driving an air compressor is an electric motor. The idea is to have compressed air on demand, but to limit the number of times the motor must start the compressor in a given time period, to prevent motor burnout.

Gas, or air, compressors use a variety of devices to control the operation of the compressor. The control type employed is determined by how frequent there is a demand for compressed air. A compressor that encounters varying periods of light and heavy usage, can be equipped with two, or more, control types, which is generically known in the industry as dual controls. The operator can manually switch between each control type, depending on the demand for compressed air.

As can be appreciated, the dual control compressor for a pressurized air system requires a number of parts, connections, and space to be set up and function properly. Thus, against this background, an improved dual control for a compressor is needed.

SUMMARY OF THE INVENTION

One aspect of the present disclosure relates to a gas compressor system that includes a gas receiver, a compressor, a motor, and a continuous run controller. The gas receiver is configured to store a volume of gas. The compressor is coupled in flow communication with the gas receiver and includes a lubrication system and a suction valve unloader. The motor is operable to power the compressor. The continuous run controller is coupled in flow communication with the gas receiver and the compressor. The continuous run controller includes an integrated housing, a pilot valve, and a hydraulic unloader valve. The housing includes an inlet port in flow communication with the gas receiver, an outlet port in flow communication with the suction valve unloader, and at least first and second component ports. The pilot valve is mounted in the first component port and arranged in flow communication with the inlet and outlet ports. The hydraulic unloader valve is mounted in the second component port and arranged in flow communication with the inlet and outlet ports and the lubrication system. When gas pressure in the gas receiver is below a threshold level, the pilot valve closes to reduce pressure supplied to the suction valve unloader thereby allowing the compressor to generate compressed air. When gas pressure in the gas receiver is above a threshold level, the pilot valve opens to increase pressure supplied to the suction valve unloader thereby restricting the compressor from generating compressed air. When oil pressure in the lubrication system is above a threshold level, the hydraulic unloader valve closes to reduce pressure to the suction valve unloader thereby allowing the compressor to generate compressed air. When oil pressure in the lubrication system is below a threshold level, the hydraulic unloader valve opens to increase pressure to the suction valve unloader thereby restricting the compressor from generating compressed air.

The integrated housing may also include a third component port, and the continuous run controller may also include a check valve mounted in the third component port and arranged in flow communication between the outlet port and the pilot valve, and positioned between the outlet port and the hydraulic unloader valve. The check valve may include a check valve inlet in flow communication with the pilot valve and the hydraulic unloader valve, a check valve seat, a disc movable between opened and closed positions relative to the check valve seat, and a check valve outlet in flow communication with the outlet port. The hydraulic unloader valve may include a hydraulic valve inlet in flow communication with the inlet port, a hydraulic valve seat, a plunger operable between opened and closed positions relative to the hydraulic valve seat, a plunger spring operable to bias the plunger into the opened position, a lubrication system port in fluid communication with the lubrication system, and a hydraulic valve outlet in flow communication with the outlet port.

The hydraulic unloader valve may also include a diaphragm that includes a first side and a second side, the first side operably coupled to the plunger and the second side in fluid communication with oil from the lubrication system such that oil pressure in the lubrication system moves the diaphragm against biasing forces of the plunger spring to move the plunger into the closed position. The pilot valve may include a pilot valve inlet in flow communication with the inlet port, a pilot valve seat, a ball operable between opened and closed positions relative to the pilot valve seat, a pilot valve spring operable to bias the ball into the closed position, and a pilot valve outlet in flow communication with the outlet port. The gas compressor system may further include a pressure switch operably coupled to the gas receiver and the motor, wherein the pressure switch is operable to cause the motor to start when pressure in the gas receiver drops below a first pressure level and to stop the motor when pressure in the gas receiver exceeds a second pressure level. The integrated housing may include a single, unitary piece.

Another aspect of the present disclosure relates to a continuous run controller for a gas compressor system. The continuous run controller includes an integrated housing, a pilot valve, and a hydraulic unloader valve. The integrated housing includes an inlet port, an outlet port, and at least first and second component ports. The pilot valve is mounted in the first component port and arranged in flow communication with the inlet and outlet ports. The hydraulic unloader valve is mounted in the second component port and arranged in flow communication with the inlet and outlet ports and a lubrication system of the gas compressor system. When gas pressure at the inlet port is below a threshold level, the pilot valve closes to reduce gas pressure available at the outlet port. When gas pressure at the inlet port is above a threshold level, the pilot valve opens to increase gas pressure available at the outlet port. When oil pressure available to the hydraulic unloader valve is above a threshold level, the hydraulic unloader valve closes to reduce gas pressure available at the outlet port. When oil pressure available to the hydraulic unloader valve is below a threshold level, the hydraulic unloader valve opens to increase gas pressure available at the outlet port. Changes in gas pressure at the outlet port causes loading and unloading of a suction valve of a compressor of the gas compressor system.

The integrated housing may further include a third component port, and the continuous run controller may further include a check valve mounted in the third component port and arranged in flow communication between the outlet port and the pilot valve, and between the outlet port and the hydraulic unloader valve. The check valve may include at least one check valve inlet in flow communication with the pilot valve and the hydraulic unloader valve, a check valve seat, a disc movable between opened and closed positions relative to the check valve seat, and a check valve outlet in flow communication with the outlet port. The hydraulic unloader valve may include an hydraulic unloader valve inlet in flow communication with the inlet port, a hydraulic valve seat, a plunger operable between opened and closed positions relative to the hydraulic valve seat, a plunger spring operable to bias the plunger into the opened position, a lubrication system port in fluid communication with the lubrication system, and a hydraulic valve outlet in flow communication with the outlet port.

The hydraulic unloader valve of the continuous run controller further comprises a diaphragm, the diaphragm comprising a first side and a second side, the first side operably coupled to the plunger and the second side in fluid communication with oil from the lubrication system such that oil pressure in the lubrication system causes movement of the diaphragm that overcomes the plunger spring to move the plunger into the closed position.

The pilot valve may include a pilot valve inlet in flow communication with the inlet port, a pilot valve seat, a ball operable between opened and closed positions relative to the pilot valve seat, a pilot valve spring operable to bias the ball into the closed position, and a pilot valve outlet in flow communication with the outlet port. The continuous run controller may also include a pressure switch operably coupled to a gas receiver and the motor of the gas compressor system, wherein the pressure switch is operable to cause the motor to start when pressure in the gas receiver drops below a first pressure level and to stop the motor when pressure in the gas receiver exceeds a second pressure level. The integrated housing may be formed as a single, unitary piece.

Another aspect of the present disclosure relates to a method of controlling operation of a compressor of a gas compressor system. The method includes providing a gas receiver, a motor, a compressor coupled in flow communication with the gas receiver, and a continuous run controller coupled in flow communication with the gas receiver and the compressor, the compressor comprising a lubrication system and a suction valve unloader. The continuous run controller includes an integrated housing having inlet and outlet ports, a pilot valve mounted in a first component port of the housing and arranged in flow communication with the inlet and outlet ports, and a hydraulic unloader valve mounted in a second component portion of the housing and arranged in flow communication with the inlet and outlet ports and the lubrication system. The housing has an inlet port in flow communication with the gas receiver and an outlet port in flow communication with the suction valve unloader. The method further includes closing the pilot valve when gas pressure in the gas receiver is below a threshold level to reduce pressure supplied to the suction valve unloader thereby allowing the compressor to generate compressed air, opening the pilot valve when gas pressure in the gas receiver is above a threshold level to increase pressure supplied to the suction valve unloader thereby restricting the compressor from generating compressed air, closing the hydraulic unloader valve when oil pressure in the lubrication system is above a threshold level to reduce pressure to the suction valve unloader thereby allowing the compressor to generate compressed air, and opening the hydraulic unloader valve when oil pressure in the lubrication system is below a threshold level to increase pressure to the suction valve unloader thereby restricting the compressor from generating compressed air.

Closing and opening the pilot valve may include moving a pilot valve ball relative to a seat of the pilot valve. Opening and closing the hydraulic unloader valve may include moving a diaphragm of the hydraulic unloader valve. The method may also include providing a check valve mounted in a third component port of the housing and in flow communication between the outlet port and the pilot and hydraulic unloader valves.

BRIEF DESCRIPTION OF THE DRAWINGS

The accompanying drawings illustrate various embodiments of the present method and system and are a part of the specification. The illustrated embodiments are merely examples of the present system and method and do not limit the scope thereof.

Throughout the drawings, identical reference numbers designate similar, but not necessarily identical, elements.

DETAILED DESCRIPTION OF THE INVENTION

The present disclosure is directed to compressor systems such as an air or gas compressor system. The terms "air" and "gas" are used interchangeably throughout the present disclosure. In particular, the present disclosure is directed to controls for a compressed air system. The compressed air system may include two different modes. One mode may be particularly useful during periods of light usage of the compressor system. The other mode may be particularly useful for heavy usage of the compressor. Various aspects of the present disclosure are focused on the second mode, and may provide automatic control of the compressor system to generate compressed air.

Existing compressor systems may utilize a plurality of valve structures interconnected with separate hoses or lines as part of a control system that is operable during heavy usage of the compressor system. One aspect of the present disclosure is directed to integration of the plurality of valve members into a single, integrated housing, which may have a number of advantages over existing designs. For example, the single, integrated housing may provide easier assembly because fewer parts are required and the assembly is consolidated at a single location. Another advantage may relate to faster responses to pressure changes because of the relative close proximity between the valves and the air channels formed in the housing that interconnect the valves. A further example may be the reduced probability for leaks because fewer connections are required when using an single, integrated housing. Maintenance costs and maintenance time may be reduced because fewer parts are required and many of the parts are enclosed internally within the housing and protected from the environment. Generally, less material may be required and less material handling is necessary in order to manufacture a single, integrated housing as compared to other designs. The single, integrated housing may provide a substantially more compact structure that requires less space for shipping, retail display, and in-the-field use. Further advantages may be apparent in view of the descriptions provided below with reference to the attached figures and in comparing existing designs to the new control features disclosed herein.

Figure 1:
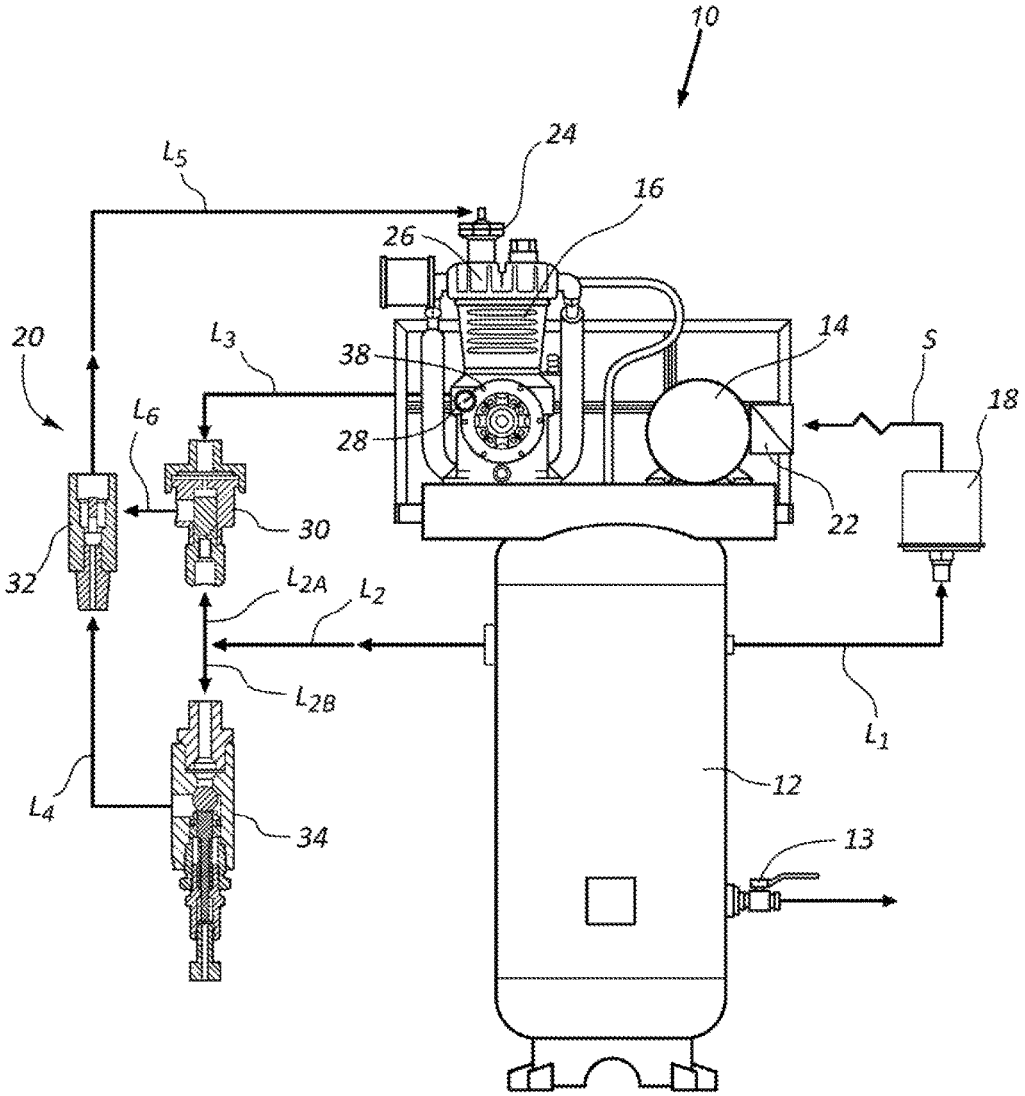
FIG. 1 (Prior Art)
FIG. 1 is a diagram of a prior art dual control compressor system.

Referring now to FIG. 1, a conventional dual-control pressurized compressor system 10 is shown and described. Compressor system 10 includes an air receiver 12, a motor 14, a compressor 16, a pressure switch 18, and a controller assembly 20. Pressure switch 18 may include a switch controller 22. Controller assembly 20 includes a suction valve unloader assembly 24, a suction valve 26, an oil pressure sensor 28, a hydraulic unloader valve 30, a check valve 32, a pilot valve 34, and a lubrication system 38. The components in compressor system 10 are interconnected with flow lines $L_1$-$L_6$, as shown in FIG. 1.

During periods of relatively low usage or demand, the compressor system 10 is controlled by pressure switch 18. Pressure switch 18, which may alternatively be a conventional pressure sensor, monitors the pressure in air receiver 12. Release of air from air receiver 12 through a discharge 13 causes the pressure to decrease within air receiver 12. Pressure switch 18 has a low pressure threshold that causes pressure switch 18 to change state and send a signal S to switch controller 22 to start motor 14. Motor 14 starts and, as explained above, operates compressor 16 to inject pressurized air into air receiver 12, thus causing air pressure to increase within air receiver 12. When the air pressure exceeds a high pressure threshold, pressure switch 18 sends a signal S to switch controller 22 to stop motor 14. Typically, the low pressure threshold is below the high pressure threshold to minimize on/off cycles of the motor 14. Alternatively, the low pressure threshold and high pressure threshold may be set at substantially the same level.

As may be appreciated, high demands for pressurized air from air receiver 12 will cause motor 14 to cycle on and off frequently. This frequent on and off cycling should be avoided if possible in order minimize wear on motor 14 and compressor 16. Motor 14 may be continuously running during periods of high demand on the compressor system 10 to avoid cycling motor 14 on and off. However, continually providing pressurized air to air receiver 12 may cause an over-pressure condition that results in automatic opening of a pressure relief valve (not shown). Cycling of the pressure relief valve should also be avoided in order to minimize wear and possible failure of the pressure relief valve. In order to address these issues, compressor system 10 may be provided with a continuous run control scheme using components of controller assembly 20.

Pilot valve 34 may be used in combination with suction valve unloader assembly 24 to control when compressor 16 is turned on and off while motor 14 continues to run. Once started, motor 14 runs continuously until manually stopped. Compressor 16 will compress air until the demand within air receiver 12 is satisfied. At that point, pressure will open pilot valve 34, thus allowing air pressure to pass to suction valve unloader assembly 24. Suction valve unloader assembly 24 unseats suction valve 26 of compressor 16, which inhibits the compressor 16 from drawing air into its compressor chamber (not shown) to create compressed air. In other words, motor 14 continues to run, but compressor 16 stops compressing air. Compressor 16 operates unloaded until the air receiver 12 pressure drops to below a low threshold level. At that point, pilot valve 34 closes and vents the pressure to the suction valve unloader assembly 24 to release pressure from suction valve unloader assembly 24, thereby seating suction valve 26. The compressor 16 is then able to draw air into the compression chamber of compressor 16 such that compressor 16 is again permitted to compress air. The compressed air is delivered to and stored within air receiver 12. This control method allows the compressor 16 to always be ready to compress air while avoiding cycling or straining motor 14 with repeated starting and stopping.

Operation of compressor 16 requires lubrication, typically in the form of oil, to allow the mechanical parts to move with limited friction. Compressor 16 may include hydraulic unloader valve 30 to protect compressor 16 from low oil pressure situations. Hydraulic unloader valve 30 receives an oil pressure input from lubrication system 38 and an air pressure input from air receiver 12. At startup of compressor 16, no oil pressure is typically present in lubrication system 38 of compressor 16. In this state, pressurized air within air receiver 12 causes hydraulic unloader valve 30 to open and allows pressurized air to pass to suction valve unloader assembly 24. Suction valve unloader assembly 24 unseats the suction valve 26 of compressor 16, as explained above. This causes compressor 16 to start up without a load, which allows for oil pressure in the lubrication system 38 to build up before compressor 16 is allowed to generate compressed air. This scenario is commonly referred to as a loadless start. As the oil pressure builds up above a pressure set point within lubrication system 38, the oil pressure from lubrication system 38 overcomes the air pressure force and causes hydraulic unloader valve 30 to close. The closing of the hydraulic unloader valve 30 vents the pressurized air to the suction valve unloader assembly 24, which causes the suction valve 26 to seal and the compressor 16 is loaded only subsequent to the lubrication system being brought up to operation oil pressure. This allows compressor 16 to start compressing air, and the compressed air is delivered to air receiver 12.

Hydraulic unloader valve 30 also protects compressor 16 in the event of an unexpected, potentially damaging oil pressure drop during operation. If the oil pressure drops for any reason, hydraulic unloader valve 30 opens, compressed air is delivered to suction valve unloader assembly 24, suction valve 26 opens, and compressor 16 is unloaded to stop generation of compressed air.

Check valve 32 operates to control air flow from hydraulic unloader valve 30 and pilot valve 34 in a single direction of flow towards suction valve unloader assembly 24. Check valve 32 prevents backflow of air between hydraulic unloader valve 30 and pilot valve 34.

As shown in FIG. 1, a plurality of air flow lines $L_{2A}$, $L_{2B}$, $L_4$ and $L_6$ are required to interconnect hydraulic unloader valve 30, check valve 32, and pilot valve 34. In practice, each of the lines (e.g., hoses, pipes or tubing) requires connectors (e.g., fittings) for securing to the valves and a length of the line sufficiently long to permit assembly of the valves together and connection of the connectors. Proper connecting of the fittings and lines to each of the valves typically requires significant time and energy during assembly and also requires a large number of parts and a substantial amount of material. Furthermore, the interconnecting lines and associated connectors are bulky, require large amounts of space, and are exposed for contact to environmental conditions, such as those conditions that may be present during manufacture, shipping, retail display, and in-the-field use. The lines may be susceptible to damage, such as being punctured, kinked, or worn, that causes failure of the controller assembly 20. Furthermore, each of the fittings used to connect the hoses to each of the valves may be susceptible to leaks. The length of the lines may delay the response time to changes in pressure conditions during the automated control provided by controller assembly 20.

Many of the disadvantages of compressor system 10 may be addressed by an improved compressor system and related controller assembly 120 described with reference to FIGS. 2-5. For example, referring to FIG. 2, controller assembly 120 includes, in addition to the suction valve unloader assembly 24, suction valve 26, oil pressure sensor 28, and lubrication system 38 described with reference to the compressor system 10 of FIG. 1, as well as a hydraulic unloader valve 130, check valve 132, pilot valve 134, and housing 136, shown in FIG. 2. Housing 136 takes the place of the interconnecting lines $L_{2A}$, $L_{2B}$, $L_4$ and $L_6$ of controller assembly 20 and their associated fittings described with reference to FIG. 1. Housing 136 may be an integrated, single-piece structure. Alternatively, housing 136 may include a plurality of housing sections that are connected together to form a singular housing structure that houses and/or couples together hydraulic unloader valve 30, check valve 32, and pilot valve 34. In at least one example, housing 136 comprises a single block of material with a plurality of bores formed therein. The bores may provide interconnecting flow channels, valve seats, and connecting features (e.g., threaded bores) that provide flow communication between the valves as well as provide mounting structures for connecting the valves to housing 136.

Figure 2:
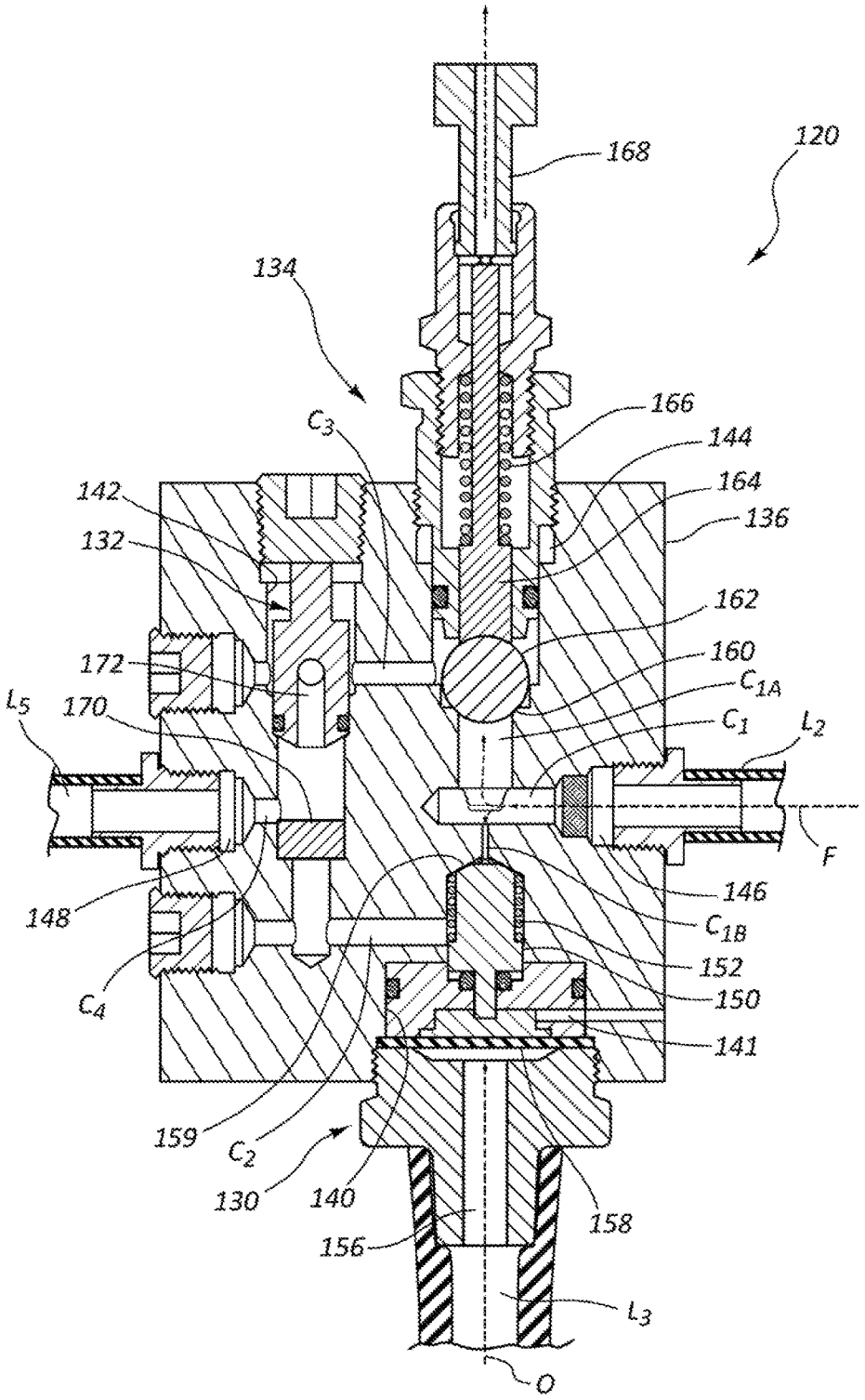
FIG. 2 is a cross-sectional view of a controller assembly for a dual control compressor system in a closed state in accordance with the present disclosure.

The controller assembly 120 may be particularly useful for a continuously running motor associated with a compressor, such as the motor 14 described above with reference to FIG. 1. Motor 14 may include, for example, an electric motor. Housing 136 is shown in FIG. 2 as a single block of material. Housing 136 may have other shapes and any desired size. The size of housing 136 may depend upon the sizes of hydraulic unloader valve 130, check valve 132, and pilot valve 134, and their associated features for connecting to housing 136. The term "integrated housing" is used herein to denote a single, monolithic piece. The integrated housing may also include the operational components and the like for housing 136 and/or controller assembly 120, generally.

Housing 136 provides first, second and third component seats 140, 142, 144, an inlet port 146, an outlet port 148, and a plurality of internal channels $C_1$, $C_{1A}$, $C_{1B}$, $C_2$, $C_3$, and $C_4$. Lines $L_2$, $L_5$ may be connected to and/or in flow communication with the inlet and outlet ports 146, 148. Line $L_3$ may be connected to and/or in flow communication with hydraulic unloader valve 130. Line $L_2$ is in flow communication with air receiver 12. Line $L_3$ is in flow communication with lubrication system 38.

Hydraulic unloader valve 130, check valve 132, and pilot valve 134 may be mounted in the first, second and third component seats 140, 142, 144, respectively, with conventional threaded connections. Alternatively, welds, adhesives, or other permanent connection methods, as well as other releasable connection methods may be used to secure valves 130, 132, 134 within seats 140, 142, 144, respectively.

Channel $C_1$ is connected in flow communication with inlet port 146, and hence a flow of air F from air receiver 12 via line $L_1$. Channel $C_1$ is pressurized to approximately the same pressure as the pressurized air receiver 12. Channels $C_{1A}$ and $C_{1B}$ are arranged in flow communication with channel $C_1$, and are also pressurized to approximately the same pressure as air receiver 12. Channel $C_2$ provides flow communication between an outlet of hydraulic unloader valve 130 and an inlet of check valve 132. Channel $C_3$ provides flow communication between an outlet of pilot valve 134 and an inlet of check valve 132. Channel $C_4$ provides flow communication from check valve 132 to the outlet port 148 and line $L_5$. Line $L_5$ is connected in flow communication with suction valve unloader assembly 24.

Hydraulic unloader valve 130 includes a plunger 150, a spring 152, and/or a discharge (not shown), an oil inlet 156, a diaphragm 158, and a seat 159. Spring 152 biases plunger 150 away from seat 159. Further, air pressure within channel $C_{1B}$ moves plunger 150 away from seat 159. Oil pressure from lubrication system 38 builds within oil inlet 156 as a flow of oil O to move diaphragm 158 against the biasing forces of spring 152 and the air pressure within channel $C_{1B}$ to force plunger 150 against seat 159 to close hydraulic unloader valve 130 (see FIGS. 2 and 4). When the oil pressure is reduced within lubrication system 38 (e.g., at oil inlet 156), the biasing forces of spring 152 and/or the pressure of air within channel $C_{1B}$ overcome the forces of diaphragm 158 to move plunger 150 away from seat 159 to open hydraulic unloader valve 130 (see FIG. 3). When the oil pressure within lubrication system 38 is again reduced, hydraulic unloader valve 130 moves from the open position of FIG. 3 back to the closed position of FIG. 4. When hydraulic unloader valve 130 is in the closed position, pressurized air from line $L_5$ is vented through air vent 141.

Check valve 132 includes a disc 170 that moves within seat 142 to control air flow into channel $C_4$ and out through outlet port 148. In a first position (see FIGS. 2 and 3), disc 170 is in a position that permits air flow from hydraulic unloader valve 130, through channel $C_2$, and out through channel $C_4$. In a second position shown in FIG. 4, disc 170 is moved into a different position within seat 142 that permits air flow from pilot valve 134, through channel $C_3$ and a flow channel 172 of check valve 132, and out through channel $C_4$ and outlet port 148. In the first position shown in FIGS. 2 and 3, disc 170 blocks air flow from pilot valve 134 and prevent backflow of airflow into pilot valve 134. In the second position shown in FIG. 4, disc 170 blocks air flow from hydraulic unloader valve 130 and prevents backflow of airflow into hydraulic unloader valve 130.

Figure 3:
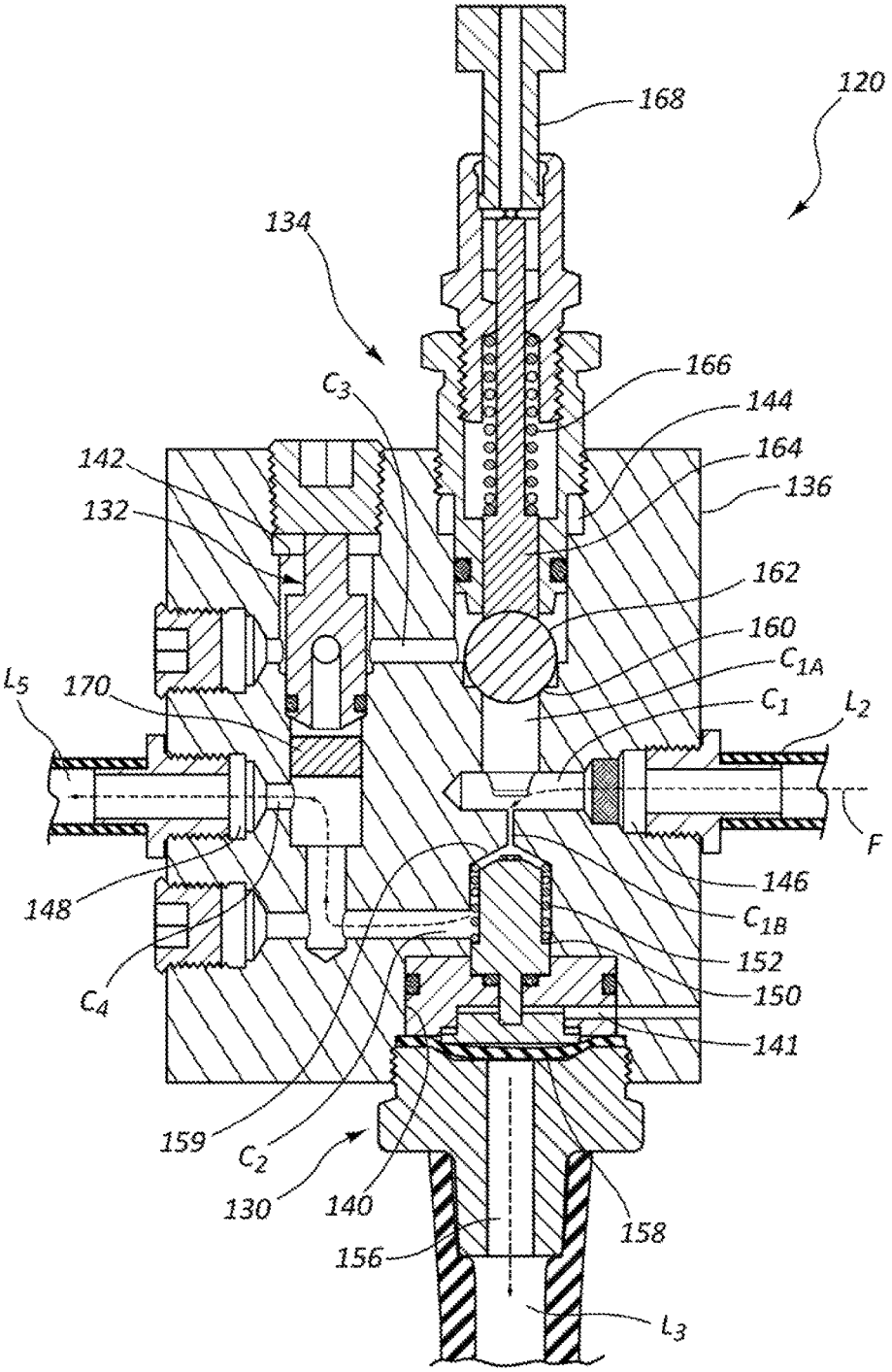
FIG. 3 shows the controller assembly of FIG. 2 in a first open state.
Figure 4:
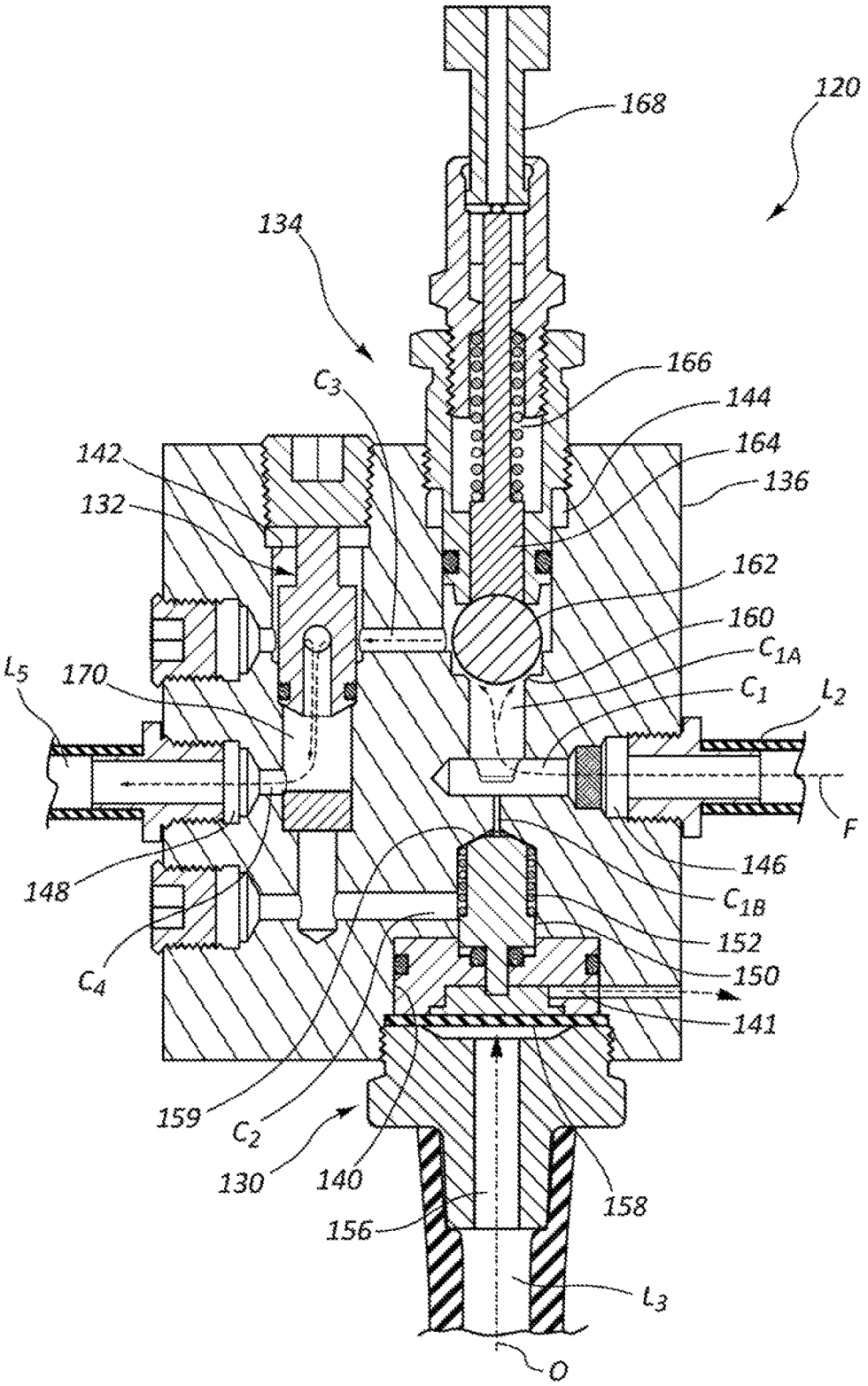
FIG. 4 shows the controller assembly of FIG. 2 in a second open state.

Pilot valve 134 includes a valve seat 160, a ball 162, a valve stem 164, a spring 166, and an air vent port 168. Ball 162 is biased into a closed position in contact with valve seat 160 by spring 166. FIGS. 2 and 3 show ball 162 in a closed position in contact with valve seat 160. FIG. 4 shows ball 162 moved against the biasing forces of spring 166 to open pilot valve 134. Air vent port 168 vents pressurized air from line $L_5$ and pilot valve 134 when pilot valve 134 is in the closed position shown in FIGS. 2 and 3. Air vent port 168 may remain in a closed position when pilot valve 134 is in the open position of FIG. 4.

Pilot valve 134 typically moves into the open position of FIG. 4 when pressure within channel $C_{1A}$ exceeds a threshold pressure level. The pressure within channel $C_{1A}$ forces ball 162 against the biasing forces of spring 166, thereby permitting air flow through pilot valve 134, channel $C_3$, check valve 132, and out through outlet port 148.

In alternative embodiments, controller assembly 120 does not include a separate check valve 132. For example, housing 136 may be void of the separate component seat 142 and the outlets of both of the hydraulic unloader valve 130 and pilot valve 134 may be directly connected to outlet port 148.

Figure 5:
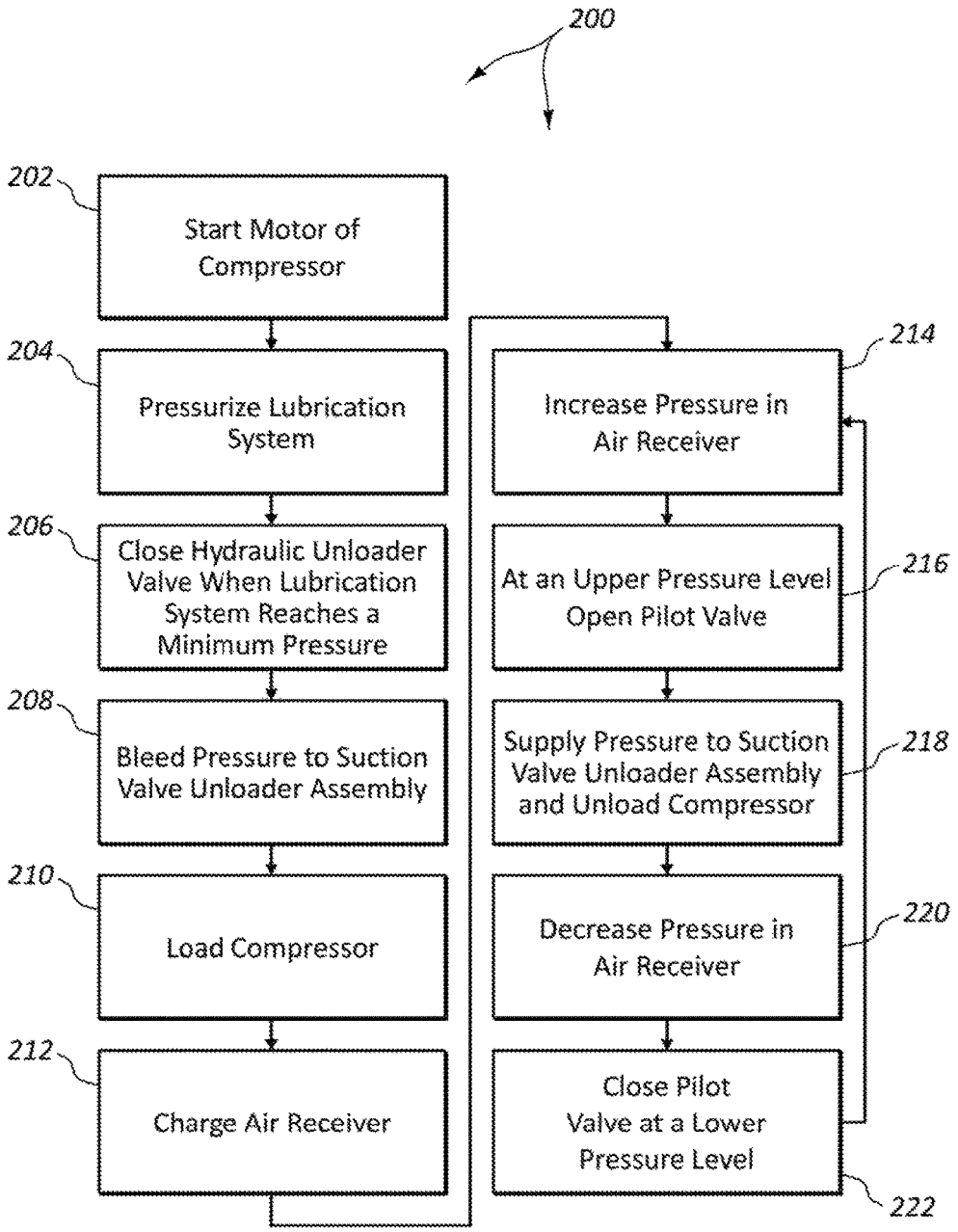
FIG. 5 is a block diagram showing an example method of operating the controller assembly of FIG. 2 in accordance with the present disclosure.

Referring now to FIG. 5, an example method 200 is shown as a flow chart. The method 200 is initiated with starting the motor of the compressor in a block 202. Starting the motor pressurizes the lubrication system in a block 204. A block 206 includes closing the hydraulic unloader valve when the lubrication system reaches a minimum pressure. Block 208 includes bleeding pressure to the suction valve unloader assembly. Block 210 includes loading the compressor. Block 212 includes charging the air receiver. Block 214 includes increasing pressure in the air receiver. At an upper pressure level, the pilot valve is opened at block 216. Block 218 includes supplying pressure to the suction valve unloader assembly to unload the compressor. Block 220 includes decreasing pressure in the air receiver, followed by closing the pilot valve at a lower pressure level at block 222.

According to method 200, the compressor remains unloaded while the motor runs until the lubrication system is fully pressurized. Once the lubrication system is pressurized, the hydraulic loader valve closes to stop the flow of pressurized air to the suction valve unloader assembly, thereby permitting the compressor to begin running to generate compressed air. The hydraulic unloader valve and pilot valve remain closed until pressure within the air receiver reaches a high pressure threshold. The high pressure threshold opens the pilot valve to permit a flow of pressurized air to be delivered to the suction valve unloader assembly, which causes the compressor to turn off while the motor continues running. The compressor remains in an off state until air from the air receiver is discharged to a point that the pressure condition in the air receiver reaches a low threshold condition. Once the low threshold pressure condition is met, the pilot valve again closes, which bleeds the pressurized air available to suction valve unloader assembly, and results in the compressor turning on again to generate compressed air.

The method 200 continues to cycle between blocks to 222 and 214 continually until an operator manually turns off the motor.

The controller assembly 120 described with reference to FIGS. 2-4 may also provide a backup safety system in the event that the lubrication system for the compressor fails. In the event that the lubrication system fails or the oil pressure drops for any reason (e.g., a leak in the lubrication system), the hydraulic unloader valve 130 opens, which results in the compressor being turned off even while the motor continues to run.

As discussed above, the integrated housing 136 may provide a number of advantages as compared to a controller assembly having components that are interconnected with a plurality of separate lines and fittings. The internal channels $C_1$-$C_4$ may be sealed upon connection of the hydraulic unloader valve 130, check valve 132, pilot valve 134 and fittings for lines $L_2$ and $L_5$ at the inlet and outlet ports 146, 148 to housing 136. The channels $C_1$-$C_4$ are protected from environmental conditions. Further, the channels $C_1$-$C_4$ may be relatively small in size and short in length while still providing the desired flow communication between the inlet and outlet ports 146, 148. The smaller size and shorter length of channels $C_1$-$C_4$ as compared to the lines $L_{2A}$, $L_{2B}$, $L_4$ and $L_6$ of compressor system 10 described with reference to FIG. 1 may provide improved response times for the automated features and functionality of controller assembly 120 as compared to the controller assembly 20 of FIG. 1.

Additionally, manufacture and assembly of controller assembly 120 may be simplified because of the reduced number of parts when using integrated housing 136. The cost of the controller assembly 120 may also be reduced because of the reduced number of parts and/or the reduced amount of material required. Furthermore, manufacturing and assembly, as well as maintenance, may be simplified because the housing 136 may be a more stable, easier to handle and maneuver component for connection of the various valves, lines, fittings, etc. as compared to the plurality of separate and freely moveable components, lines, hoses, fittings, etc. associated with controller assembly 20 of FIG. 1.

The example controller assembly 120 shown with reference to FIGS. 2-4 may be modified in other embodiments while still providing at least some of the same functionality. For example, controller assembly 122 provides both air flow pressure control using pilot valve 134 as well as providing hydraulic control for protection of the compressor using hydraulic unloader valve 130. One or the other of hydraulic unloader valve 130 and pilot valve 134 may be eliminated from the system or at least be removed from integration with housing 136, although such a modification would eliminate at least some of the advantages of the integrated housing 136. In yet further embodiments, additional components (e.g., valves, fittings, air channels, sensors, etc.) may also be integrated into housing 136. Housing 136 may include additional ports, channels, mounting seats, etc. to accommodate such additional components. Such further integration may additionally enhance at least some of the advantages described above for using integrated housing 136 as part of controller assembly 120.

While the technology of the present application is described with respect to a dual control gas compressor, the technology disclosed herein may be applicable to other compressors. Moreover, the technology disclosed herein will be described with reference to certain exemplary embodiments. The word "exemplary" is used herein to mean "serving as an example, instance, or illustration." Any embodiment described herein as "exemplary" is not necessarily to be construed as preferred or advantageous over other embodiments absent a specific indication that such an embodiment is preferred or advantageous over other embodiments. Moreover, in certain instances only a single "exemplary" embodiment is provided. A single example is not necessarily to be construed as the only embodiment. The detailed description includes specific details for the purpose of providing a thorough understanding of the technology of the present patent application. However, on reading the disclosure, it will be apparent to those skilled in the art that the technology of the present patent application may be practiced with or without these specific details. In some descriptions herein, generally understood structures and devices may be shown in block diagrams to aid in understanding the technology of the present patent application without obscuring the technology herein. In certain instances and examples herein, the term "coupled" or "in communication with" means connected using either a direct link or indirect data link as is generally understood in the art. Moreover, the connections may be wired or wireless, private or public networks, or the like.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A continuous run controller for a gas compressor system, the continuous run controller comprising:

an integrated housing, comprising:

an inlet port;

an outlet port;

at least first and second component ports;

a pilot valve mounted in the first component port and arranged in flow communication with the inlet and outlet ports;

a hydraulic unloader valve mounted in the second component port and arranged in flow communication with the inlet and outlet ports and a lubrication system of the gas compressor system;

wherein when gas pressure at the inlet port is below a first threshold level, the pilot valve closes to reduce gas pressure available at the outlet port, and when gas pressure at the inlet port is above the first threshold level, the pilot valve opens to increase gas pressure available at the outlet port;

wherein when oil pressure available to the hydraulic unloader valve is above a second threshold level, the hydraulic unloader valve closes to reduce gas pressure available at the outlet port, and when oil pressure available to the hydraulic unloader valve is below the second threshold level, the hydraulic unloader valve opens to increase gas pressure available at the outlet port, wherein the second threshold level comprises at least one of a biasing force of a plunger spring in the hydraulic unloader valve and the gas pressure in a gas receiver;

wherein changes in gas pressure at the outlet port caused loading and unloading of a suction valve of a compressor of the gas compressor system.

2. The continuous run controller of claim 1 wherein the integrated housing further comprises a third component port, and the continuous run controller further comprises a check valve mounted in the third component port and arranged in flow communication between the outlet port and the pilot valve, and between the outlet port and the hydraulic unloader valve.

3. The continuous run controller of claim 2, wherein the check valve comprises at least one check valve inlet in flow communication with the pilot valve and the hydraulic unloader valve, a check valve seat, a disc movable between opened and closed positions relative to the check valve seat, and a check valve outlet in flow communication with the outlet port.

4. The continuous run controller of claim 1, wherein the hydraulic unloader valve comprises an hydraulic unloader valve inlet in flow communication with the inlet port, a hydraulic valve seat, a plunger operable between opened and closed positions relative to the hydraulic valve seat, the plunger spring operable to bias the plunger into the opened position, a lubrication system port in fluid communication with the lubrication system, and a hydraulic valve outlet in flow communication with the outlet port.

5. The continuous run controller of claim 4, wherein the hydraulic unloader valve further comprises a diaphragm, the diaphragm comprising a first side and a second side, the first side operably coupled to the plunger and the second side in fluid communication with oil from the lubrication system such that oil pressure in the lubrication system causes movement of the diaphragm that overcomes the plunger spring to move the plunger into the closed position.

6. The continuous run controller of claim 1, wherein the pilot valve comprises a pilot valve inlet in flow communication with the inlet port, a pilot valve seat, a ball operable between opened and closed positions relative to the pilot valve seat, a pilot valve spring operable to bias the ball into the closed position, and a pilot valve outlet in flow communication with the outlet port.

7. The continuous run controller of claim 1, further comprising a pressure switch operably coupled to the gas receiver and the motor of the gas compressor system, the pressure switch operable to cause the motor to start when pressure in the gas receiver drops below a first pressure level and to stop the motor when pressure in the gas receiver exceeds a second pressure level.

8. The continuous run controller of claim 1, wherein the integrated housing is formed as a single, unitary piece.

* * * * *